US005160344A

United States Patent [19]

Werton

[11] Patent Number: 5,160,344

[45] Date of Patent: Nov. 3, 1992

[54] TWO COMPONENT TEETHER

[76] Inventor: Donna L. Werton, 24664 Madison Ct. #256, Farmington Hills, Mich. 48335

[21] Appl. No.: 759,473

[22] Filed: Sep. 13, 1991

[51] Int. Cl.[5] ..... A61J 17/00

[52] U.S. Cl. ..... 606/235; 606/234

[58] Field of Search ..... 606/234, 235, 236; 215/11.1, 11.2, 11.3, 11.4, 11.5, 11.6; 248/104; 446/486

[56] References Cited

U.S. PATENT DOCUMENTS

| | | | |
|---|---|---|---|
| D. 263,999 | 4/1982 | Bergman . | |
| D. 264,630 | 5/1982 | Nakao et al. . | |
| D. 264,880 | 6/1982 | Paicci . | |
| D. 270,664 | 9/1983 | Greenberg et al. . | |
| D. 276,653 | 12/1984 | Daugherty . | |
| D. 276,738 | 12/1984 | Daugherty . | |
| D. 276,845 | 12/1984 | Daugherty . | |
| D. 277,031 | 1/1985 | Panicci . | |
| D. 280,749 | 9/1985 | Thomson et al. . | |
| D. 286,443 | 10/1986 | Thomson et al. . | |
| D. 287,377 | 12/1986 | Grubb et al. . | |
| D. 288,849 | 3/1987 | Williams et al. . | |
| D. 290,655 | 6/1987 | Thomson et al. . | |
| D. 291,122 | 7/1987 | Grubb et al. . | |
| D. 298,777 | 11/1988 | Gorman . | |
| D. 302,468 | 7/1989 | Den Oudsten-Van Der Hoek . | |
| D. 304,237 | 10/1989 | Daykin . | |
| D. 310,716 | 9/1990 | Trask . | |
| D. 310,718 | 9/1990 | Robinson . | |
| 1,095,264 | 5/1914 | Bridges | 606/235 |
| 2,421,574 | 6/1947 | Newmark | 606/235 |
| 2,514,844 | 7/1950 | Cohen | 606/235 |
| 2,604,404 | 7/1952 | Genjack . | |
| 2,703,087 | 3/1955 | Newmark | 606/235 |
| 2,705,011 | 3/1955 | Newton . | |
| 3,653,386 | 4/1972 | Jacobus . | |
| 3,669,117 | 6/1972 | Herbst | 606/235 |
| 3,875,940 | 4/1975 | Beuther | 606/234 |
| 3,990,455 | 11/1976 | Panicci . | |
| 4,026,297 | 5/1977 | Kobayashi . | |
| 4,116,202 | 9/1978 | Panicci . | |
| 4,193,407 | 3/1980 | Edmark | 606/234 |
| 4,311,149 | 1/1982 | Panicci . | |
| 4,569,349 | 2/1986 | McKee . | |
| 4,577,632 | 3/1986 | Grasset . | |
| 4,694,510 | 9/1987 | Kamrath . | |
| 4,723,801 | 2/1988 | Musumeci et al. . | |
| 4,816,003 | 3/1989 | Yip et al. . | |
| 4,905,714 | 3/1990 | Drennen . | |
| 4,955,914 | 9/1990 | Caniglia et al. . | |
| 5,013,321 | 5/1991 | MacVane | 606/234 |

FOREIGN PATENT DOCUMENTS

| | | | |
|---|---|---|---|
| 1118738 | 4/1968 | United Kingdom . | |
| 2156686 | 10/1985 | United Kingdom | 606/235 |

*Primary Examiner*—Stephen C. Pellegrino
*Assistant Examiner*—Glenn Dawson
*Attorney, Agent, or Firm*—Peter D. Keefe

[57] ABSTRACT

A two component teether, wherein a first component is structured to be held by a hand of a teething child and remains at room temperature while a second component is structured to be cooled, such as by being placed in a refrigerator freezer, and includes a resilient surface for being bitten. These two components are provided with a selectively releasable interconnection system which allows them to be mutually mated during use by the child and to be separated by a parent for cooling of the second component.

3 Claims, 2 Drawing Sheets

TWO COMPONENT TEETHER

BACKGROUND OR THE INVENTION

1. Field of the invention

The present invention relates to teethers for teething children, and in particular to a two component teether wherein one component is kept at room temperature for being held by a hand of a teething child, while the other component is cooled for being used for biting on by the child in his or her mouth.

2. Description of the Prior Art

It is well known that teething babies need to exercise their gums and erupting teeth on a chewable object. Teethers have been developed in the prior art for this purpose. Teethers are generally constructed of a resiliently deformable plastic or rubber material which permits the child to bit it, yet retains its shape and original condition after the child is through with it.

Many shapes of teethers have been forwarded in the prior art including rings, animals, and various other fanciful shapes. Following is an exemplification of the kinds of prior art teethers.

Some teethers are constructed simply, such as U.S. Pat. No. DES276,845, which discloses a kitty shaped teether, and U.S. Pat. No. DES277,031, which discloses a three pointed ring teether.

Some teethers have a permanently attached handle portion, such as U.S. Pat. No. DES264,880.

Some teethers have other parts which serve as toys or pacifiers, such as U.S. Pat. No. 4,816,003, which discloses a spinable duck within a teething ring, U.S. Pat. No. 4,577,632, which discloses a pacifier attached to a teething ring, U.S. Pat. No. 4,311,149, which discloses a plurality of beads connected with a teething ring, U.S. Pat. Nos. DES290,655 and DES302,468, which both disclose a combined rattle and teether, and U.S.. Pat. No. DES280,749, which discloses toy keys connected with a teether.

Some teethers have provision for being fluid filled, such as U.S. Pat. Nos. 4,116,202, 3,990,455, 3,669,117 and 2,703,087, as well as Great Britain Patent 2,156,686.

Some teethers are constructed of flavored plastic or rubber, such as Great Britain Patent 1,118,738.

Finally, some teethers are constructed of an edible material, such as U.S. Pat. No. 2,604,404.

It is known that a cold teether works extremely well to soothe a child's hurting gums. And, it is an established practice of parents to place their child's teether in the freezer to cool it down for later placement in the child's mouth, as discussed in hereinabove mentioned U.S. Pat. No. 2,703,087. This practice, however, has major disadvantages. The child's hand can become uncomfortably cold, and his/her hand causes the teether to more quickly warm-up, thereby limiting its soothing benefits.

Accordingly, what is needed in the prior art is a teether which specifically is intended for being cooled, and for which the cooling effect is not compromised by the child holding onto the teether.

SUMMARY OF THE INVENTION

The present invention is a teether which specifically is intended for being cooled, and for which the cooling effect is not compromised by the child holding the teether by his/her hand.

The teether according to the present invention is a two component teether. A first component is structured to be held by a hand of the child and remains at room temperature. A second component is structured to be cooled, such as by being placed in a refrigerator freezer, and includes a resilient surface for biting on. These two components are provided with a selectively releasable interconnection system which allow them to be mutually mated during use by the child and to be separated for cooling of the second component.

Accordingly, it is an object of the present invention to provide a teether which is structured as two separable components, one of which being for biting on and for being cooled, the other of which being for holding at room temperature by a child using the teether.

It is a further object of the present invention to provide a two component teether in which one component is specifically structured to provide maximum cooling function to soothe the mouth parts of a teething child.

These, and additional objects, advantages, features and benefits of the present invention will become apparent from the following specification.

DETAILED DESCRIPTION OF THE PREFERRED EMBODIMENT

Figure 1:
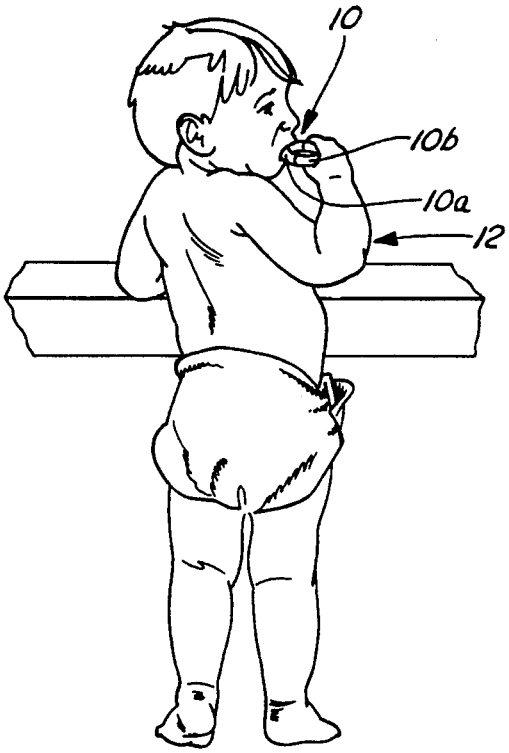
FIG. 1 is a perspective view of a teether according to the present invention in the shape of a ring, shown in operation with a teething child.

Referring now to the Drawing, FIG. 1 generally shows the teether 10 according to the present invention in operation in connection with a teething child 12. It will be seen that the teether 10 is composed of two components **10*a* and 10*b*. Biting component 10*a* is structured for being placed into the mount of the child and serves as a biting object, while grasping component 10*b* is structured for being held by a hand of the child and, preferably, may also be used for biting. While a ring shape is shown, and FIGS. 2 through 4** further structurally define the structure underlying this shape, a whole host of structural shapes are contemplated by the present invention, including, but not limited to, the various shapes known in the prior art. Accordingly, three different shapes will be discussed hereinbelow, from which a person of ordinary skill in the art will be imparted sufficient disclosure to readily adapt the novel features of the present invention to any other shaped teether.

The basic concept underlying the present invention is to provide a two component teether 10 in which one of the components is cooled while the other remains at room temperature. This feature provides for that portion of the teether which is bitten to be cold, while that portion which is grasped by the child is comfortably at room temperature.

Figure 3:
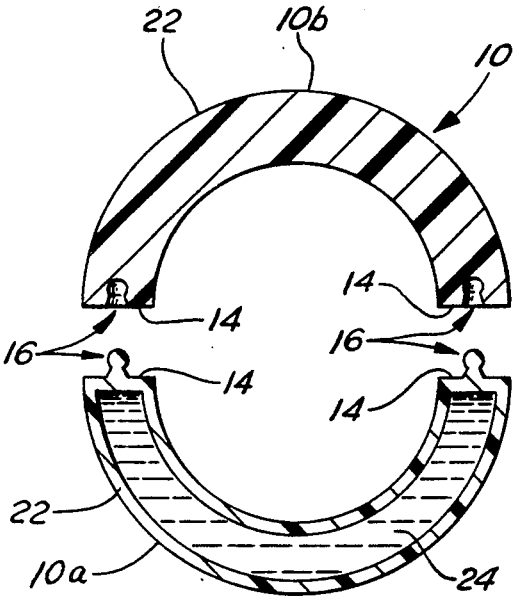
FIG. 3 is a sectional plan view of the teether according to the present invention shown along lines 3—3 in FIG. 2, a ball and socket type of interconnection system between the two components being depicted.
Figure 2:
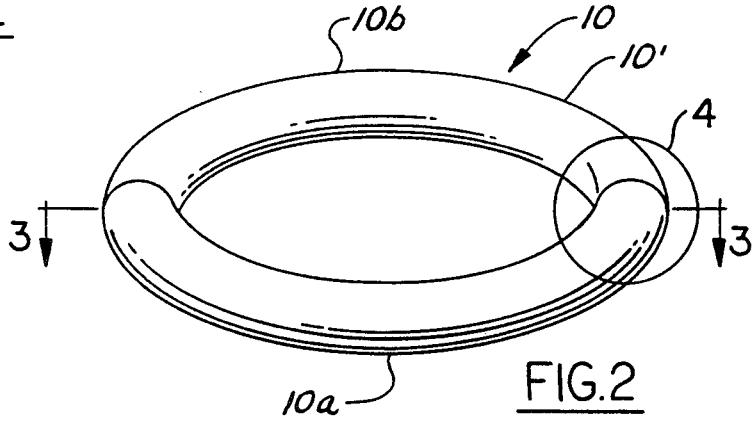
FIG. 2 is a perspective view of the teether according to the present invention.
Figure 4:
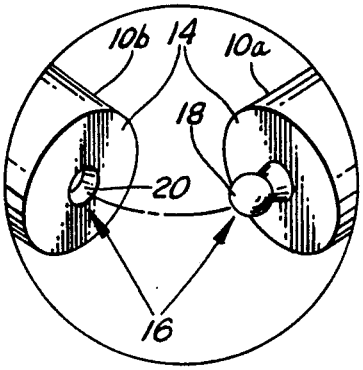
FIG. 4 is a detailed perspective view of the interconnection system depicted in the circle of FIG. 2.

Each of the components 10*a*, 10*b* is releasably connected together by an interconnection system, and the biting component 10*a* is further structured for being chilled, such as by being placed in the freezer compartment of a refrigerator. FIGS. 2 through 4 make clear one preferred embodiment for carrying out this structural arrangement of the teether 10, in this case that of a ring shape.

Biting component 10*a* and grasping component 10*b* each constitute approximately one-half of the ring 10'. The biting component 10*a* is connected to the grasping component 10*b* by any selectively releasable, interconnection system 14, depicted as a ball and socket interconnection system located at the ring end 16 of each component 10*a*, 10*b*. A ball 18 on one of the two components 10*a*, 10*b* is structured to snappingly engage a socket 20 on the other of the two components. When interconnected, the two components 10*a*, 10*b* form a completed ring 10', as shown in FIG. 2.

Biting component 10*a* is structured for being used within the mouth of the teething child 12. In this regard, the material used in its construction includes a pliable, resilient plastic or rubber bitable material 22 well known in the art which the child can bite into but not thereby ruin. It is preferred for grasping component 10*b* to the made of this type of bitable material, as well.

The biting component 10*a* is preferred to be constructed of an exterior bitable material 22 and an interior cold retaining material 24 having a large heat capacity. As shown in FIG. 3, the cold retaining material 24 may be a liquid at room temperature, but frozen when removed from the refrigerator. Such a material, such as distilled water or salted water, would undergo a phase transition involving a latent heat, thereby extracting a maximum amount of heat from the child's gums while biting thereupon. Of course, such a liquid cold retaining material 24 would be selected to be safe and non-toxic to the child should the exterior bitable material 22 by pierced during biting or play.

Figure 5:
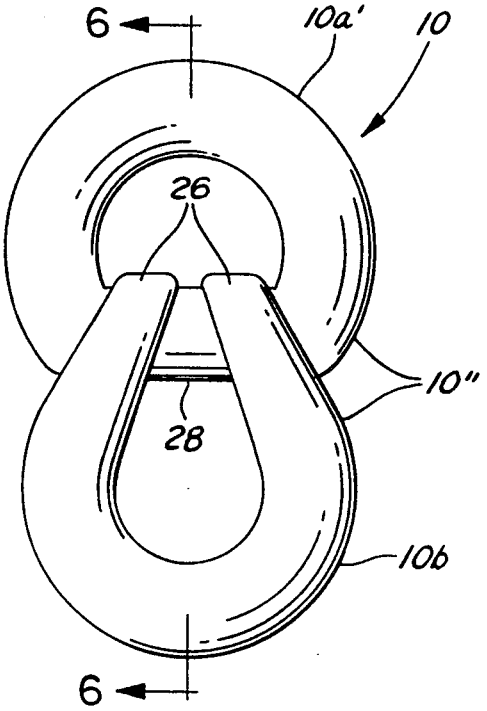
FIG. 5 is a plan view of a teether according to the present invention, a resilient clevis type of interconnection system between the two components being depicted.
Figure 6:
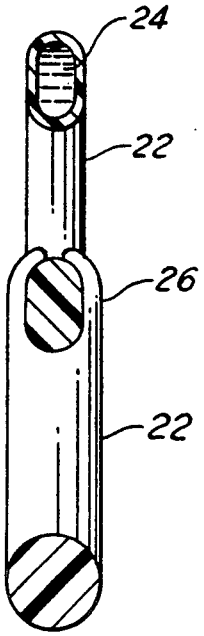
FIG. 6 is a partly sectional side view of the teether shown along lines 6—6 in FIG. 5.
Figure 7:
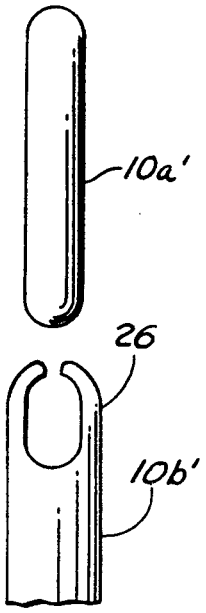
FIG. 7 is a side view of the teether of FIG. 5, now showing the two components separated from each other.

FIGS. 5 through 7 show an alternative structure 10'' for the teether 10 in the form of two components 10*a'* and 10*b'* that are mutually releasably connected by a resilient clevis structure 26. In this example, the biting component 10*a'* is structured to include an exterior bitable material 22, the hollow of which being filled with a liquid cold retaining material 24, as described hereinabove. The shape of the biting component 10*a'* is that of a modified ring with a flat section 28. The grasping component 10*b'* is constructed of the bitable material 22, as described hereinabove. The shape of the grasping component 10*b'* is that of a horseshoe in which each end includes a resilient claw shaped clevis 26. Each clevis 26 is structured to snappingly engage the flat section 28 of the biting component.

Figure 8:
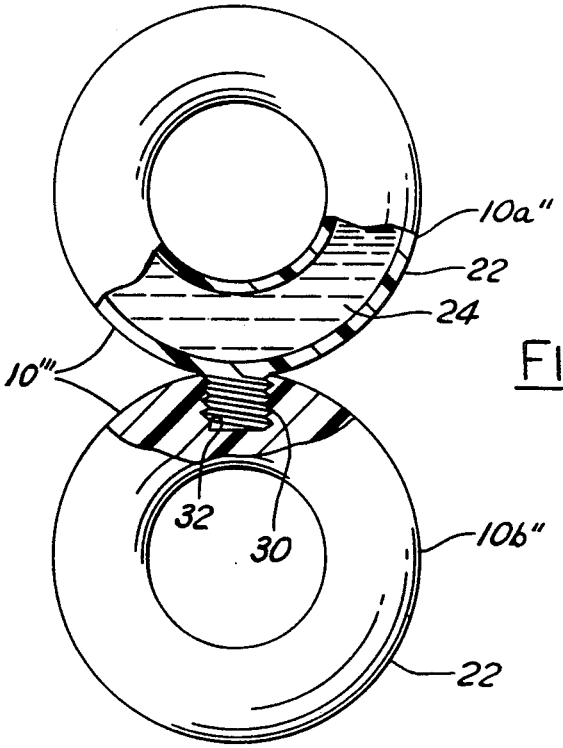
FIG. 8 is a partly sectional side view of a dual ring teether according to the present invention, a screw thread type of interconnection system between the two components being depicted.

FIG. 8 shows yet another example of alternative structure 10''' for the teether 100 in the form of two ring shaped components 100*a''* and 10*b''* that are mutually releasably connected by mutual threaded engagement. In this example, the biting component 10*a''* is structured to include a bitable material, the hollow of which being filled with a liquid cold retaining material 24, as described hereinabove. The shape of the biting component 10*a''* is that of a ring having a threaded stud 30. The grasping component 10*b''* is constructed of bitable material 22, as described hereinabove. The shape of the grasping component 10*b''* is that of a ring having a threaded blind bore 32 for threadable engagement with the threaded stud 30. Of course, either component may have either the threaded stud or the threaded blind bore.

In operation, a parent separates the two components from each other and refrigerates the biting component. Thereafter, the two components are re-united and given to the child with the biting component toward or in the child's mouth and the grasping component in the child's hand. In this regard, the shapes of the two components may be dimensioned to increase the likelihood that the child will place only the chilled biting component into his/her mouth, and hold on to only the grasping component. Further in this regard, the interconnection system should be structured so that the two components can be separated by parental manipulation, but not separated by child manipulation under normal conditions of operation.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. A method for using a teether, the teether being used to soothe the mouth parts of the mouth of a teething child, comprising the steps of:

disconnecting a first portion of the teether from a second portion of the teether;

cooling said first portion of the teether to a preselected temperature that is below room temperature;

connecting said first portion of the teether to said second portion of the teether; and inserting only said first portion of the teether into the mouth of the teething child while said first and second portions remain connected so that the first portion of the teether serves to soothe the mouth parts of the teething child.

2. The method of claim 1, further comprising the step of retaining said second portion of the teether at a temperature that is substantially that of room temperature.

3. The method of claim 2, wherein said step of inserting further comprises holding said second portion of the teether by a hand of the teething child.

* * * * *